US011047018B2

(12) United States Patent
Georgeou et al.

(10) Patent No.: US 11,047,018 B2
(45) Date of Patent: Jun. 29, 2021

(54) STEEL STRIP FOR PRODUCING A NON-GRAIN-ORIENTED ELECTRICAL STEEL, AND METHOD FOR PRODUCING SUCH A STEEL STRIP

(71) Applicant: Salzgitter Flachstahl GmbH, Salzgitter (DE)

(72) Inventors: Zacharias Georgeou, Braunschweig (DE); Frank Klose, Edernissen (DE)

(73) Assignee: SALZGITTER FLACHSTAHL GMBH, Salzgitter (DE)

( * ) Notice: Subject to any disclaimer, the term of this patent is extended or adjusted under 35 U.S.C. 154(b) by 169 days.

(21) Appl. No.: 16/320,219

(22) PCT Filed: Jul. 13, 2017

(86) PCT No.: PCT/EP2017/067703
§ 371 (c)(1),
(2) Date: Jan. 24, 2019

(87) PCT Pub. No.: WO2018/019602
PCT Pub. Date: Feb. 1, 2018

(65) Prior Publication Data

US 2019/0271053 A1 Sep. 5, 2019

(30) Foreign Application Priority Data

Jul. 29, 2016 (DE) ..... 10 2016 114 094.5

(51) Int. Cl.
*H01F 1/18* (2006.01)
*C21D 8/12* (2006.01)
(Continued)

(52) U.S. Cl.
CPC ..... *C21D 8/1283* (2013.01); *C22C 38/00* (2013.01); *C22C 38/001* (2013.01);
(Continued)

(58) Field of Classification Search
CPC .. C21D 8/1211; C21D 8/1222; C21D 8/1233; C21D 8/1261; C21D 8/1272;
(Continued)

(56) References Cited

U.S. PATENT DOCUMENTS 5,803,988 A 9/1998 Bae et al.
6,428,632 B1 8/2002 Fujiyama et al.
(Continued)

FOREIGN PATENT DOCUMENTS

DE 196 81 215 4/1998
DE 101 53 234 5/2003
(Continued)

OTHER PUBLICATIONS

Russian Search Report dated Sep. 23, 2019 with respect to counterpart Chinese patent application 2019101938/02.
(Continued)

*Primary Examiner* — Jenny R Wu
(74) *Attorney, Agent, or Firm* — Henry M. Feiereisen LLC

(57) ABSTRACT

The invention relates to a steel strip for producing a non-oriented electrical steel. To achieve greatly improved frequency-independent magnetic properties, in particular greatly reduced hysteresis losses, in comparison with known electrical steels, the following alloy composition in wt % is proposed: C: ≤0.03, Al: 1 to 12, Si: 0.3 to 3.5, Mn: >0.25 to 10, Cu: >0.05 to 3.0, Ni: >0.01 to 5.0, total of N, S and P: at most 0.07, remainder iron and smelting-related impurities, with the optional addition of one or more elements from the group Cr, Mo, Zn and Sn, wherein the steel strip has an insulation layer substantially consisting of Al2O3 and/or SiO2 with a thickness in the range from 10 μm to 100 μm. The invention also relates to a method for producing such a steel strip.

20 Claims, 1 Drawing Sheet

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/16*** | (2006.01) |
| ***H01F 1/16*** | (2006.01) |
| ***C22C 38/00*** | (2006.01) |

(52) U.S. Cl.
CPC ..... *C22C 38/004* (2013.01); *C22C 38/02* (2013.01); *C22C 38/04* (2013.01); *C22C 38/06* (2013.01); *C22C 38/08* (2013.01); *C22C 38/16* (2013.01); *H01F 1/16* (2013.01); *H01F 1/18* (2013.01); *C21D 8/1211* (2013.01); *C21D 8/1222* (2013.01); *C21D 8/1233* (2013.01); *C21D 8/1261* (2013.01); *C21D 8/1272* (2013.01); *C22C 2202/02* (2013.01)

(58) Field of Classification Search
CPC ... C21D 8/1283; C22C 2202/02; C22C 38/00; C22C 38/001; C22C 38/004; C22C 38/02; C22C 38/04; C22C 38/06; C22C 38/08; C22C 38/16; H01F 1/16; H01F 1/18
See application file for complete search history.

(56) References Cited

U.S. PATENT DOCUMENTS

| | | | |
|---|---|---|---|
| 7,140,417 | B2 | 11/2006 | Schoen et al. |
| 7,198,682 | B2 | 4/2007 | Cicale et al. |
| 7,377,986 | B2 | 5/2008 | Schoen et al. |
| 2006/0243351 | A1 | 11/2006 | Ohashi et al. |
| 2009/0202383 | A1 | 8/2009 | Tanaka et al. |
| 2011/0094699 | A1 | 4/2011 | Miyazaki et al. |
| 2013/0089943 | A1* | 4/2013 | Chen ..... H01L 31/068 438/72 |
| 2015/0013845 | A1 | 1/2015 | Georgeou et al. |

FOREIGN PATENT DOCUMENTS

| | | |
|---|---|---|
| DE | 600 20 217 | 12/2005 |
| DE | 601 08 980 | 4/2006 |
| DE | 602004008909 | 5/2008 |
| DE | 603 06 365 | 9/2009 |
| JP | 2001-172753 | 6/2001 |
| JP | 2008-223045 | 9/2008 |
| JP | 2015-224349 | 12/2015 |
| JP | 2015224339 A * | 12/2015 |
| RU | 26154232 C2 | 4/2007 |
| RU | 2536711 C1 | 12/2015 |
| WO | WO 00/75389 | 12/2000 |
| WO | WO 2013/117184 | 8/2013 |

OTHER PUBLICATIONS

Translation of Russian Search Report dated Sep. 23, 2019 with respect to counterpart Chinese patent application 2019101938/02.
International Search Report dated Nov. 1, 2017 by the European Patent Office in International Application PCT/EP2017/067703.

* cited by examiner

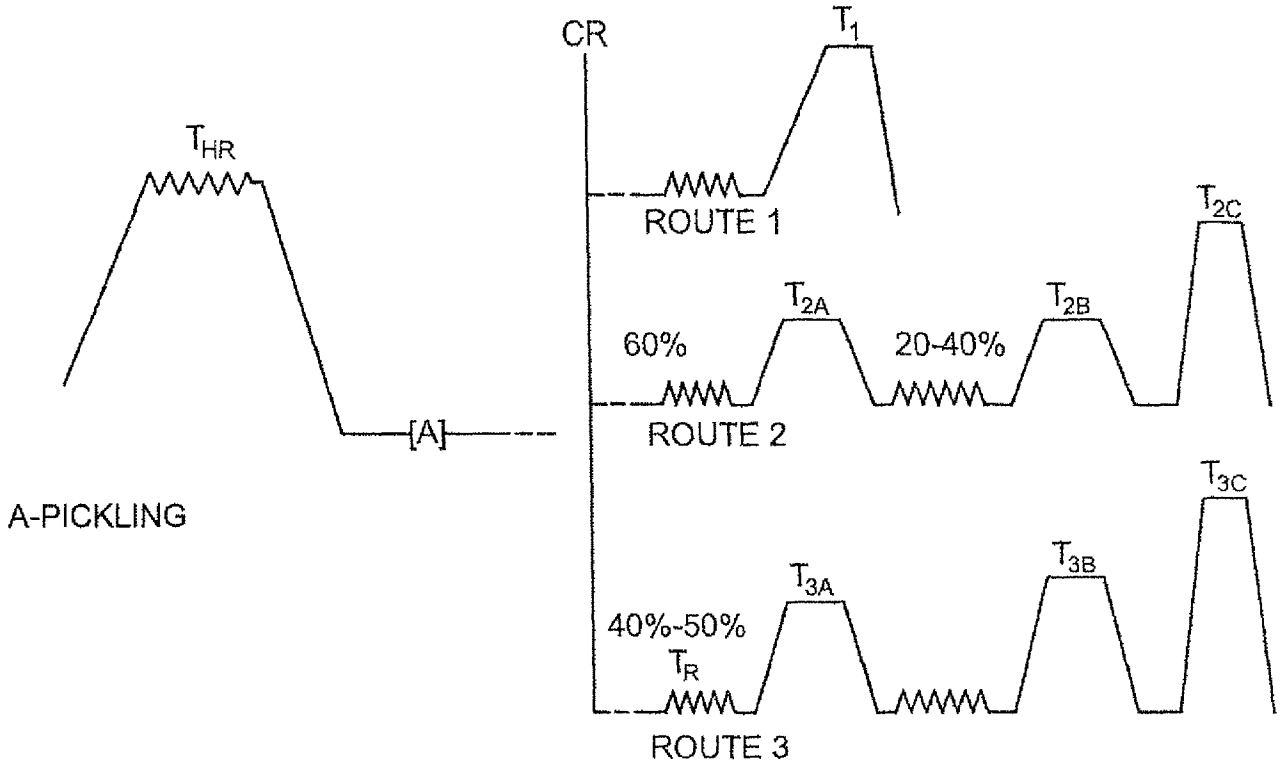
CR
$T_1$
ROUTE 1
$T_{HR}$
[A]
A-PICKLING
60%
$T_{2A}$
20-40%
$T_{2B}$
$T_{2C}$
ROUTE 2
40%-50%
$T_R$
$T_{3A}$
$T_{3B}$
$T_{3C}$
ROUTE 3

STEEL STRIP FOR PRODUCING A NON-GRAIN-ORIENTED ELECTRICAL STEEL, AND METHOD FOR PRODUCING SUCH A STEEL STRIP

CROSS-REFERENCES TO RELATED APPLICATIONS

This application is the U.S. National Stage of International Application No. PCT/EP2017/067703, filed Jul. 13, 2017, which designated the United States and has been published as International Publication No. WO 2018/0191602 and which claims the priority of German Patent Application, Serial No. 10 2016 114 094.5, filed Jul. 29, 2016, pursuant to 35 U.S.C. 119(a)-(d).

BACKGROUND OF THE INVENTION

The invention relates to a steel strip for producing a non-grain-oriented electrical steel sheet and a method for producing such a steel strip.

Materials for electrical steels are known e.g. from DE 101 53 234 A1 or DE 601 08 980 T2. They consist mostly of an iron-silicon alloy or iron-silicon-aluminium alloy, wherein a distinction is made according to grain-oriented (GO) and non-grain-oriented (NGO) electrical steels and these are used for different applications. In particular, aluminium and silicon are added in order to obtain an increase in strength and reduction in density and in particular an increase in the electrical resistance with the magnetic saturation polarization remaining unchanged as far as possible.

For applications in electrical engineering in which the magnetic flux is not fixed to a specific direction and therefore equally good magnetic properties are required in all directions, an electrical strip having the most isotropic properties possible is typically produced and is referred to as a non-grain-oriented (NGO) electrical strip. This is used predominantly in generators, electric motors, switches, relays and small transformers.

The ideal structure (structural composition) for non-grain-oriented (NGO) electrical strip is a polycrystalline microstructure having grain sizes between 20 μm and 200 μm, wherein the crystallites are randomly oriented in the sheet plane with the surface (100). However, in practice the magnetic properties of real non-grain-oriented electrical strip in the sheet plane are to a small extent dependent upon the direction of magnetization. For instance, the loss differences between the longitudinal direction and transverse direction are at most 1.0%. The development of sufficient isotropy of the magnetic properties in non-grain-oriented electrical strip is influenced substantially by the configuration of the manufacturing route of hot-forming, cold-forming and final-stage annealing.

According to the known prior art, the magnetic properties in the electrical strip are determined substantially by a high degree of purity, the content of silicon and aluminium (up to ca. 4 mass fractions in %) and targeted addition of other alloy elements, such as e.g. manganese, sulphur and nitrogen, as well as by hot-rolling, cold-rolling and annealing processes. The established sheet thicknesses are in the range of considerably less than 1 mm, e.g. 0.18 or 0.35 mm.

The material for a non-grain-oriented electrical steel, as known from laid-open document DE 101 53 234 A1, has an alloy composition in wt. %. with C<0.02%, Mn≤1.2%, Si 0.1-4.4% and Al 0.1-4.4%. Different production methods, such as thin slab or thin strip casting are described, by means of which a hot strip having a maximum thickness of 1.8 mm can be produced. By subsequent cold-rolling, it is possible to achieve a strip having a thickness of up to 0.2 mm.

Patent document DE 603 06 365 T2 discloses a material for a non-grain-oriented electrical steel in wt. %, consisting of up to about 6.5% silicon, 5% chromium, 0.05% carbon, 3% aluminium, 3% manganese, with the remainder being iron and residues. The steel strip is produced by a vertical thin slab casting method, in which the liquid steel is introduced into the casting gap of two counter-rotating, internally cooled casting rollers. The cast strip can then be hot-rolled and cold-rolled, wherein strip thicknesses of less than 1 mm are achieved.

A hot strip for producing a non-grain-oriented or grain-oriented electrical steel is known from laid-open document WO 2013/117184 A1, wherein the hot strip consists of the following alloy composition in wt. %: C: 0.001 to 0.08, Al: 4.8 to 20, Si: 0.05 to 10, B: up to 0.1, Zr: up to 0.1, Cr: 0.1 to 4, with the remainder being iron and melting-induced impurities. The hot strip is produced in such a manner that the melt is initially cast in a horizontal strip casting installation, in a flow-calmed manner and without bending, to form a pre-strip in the range between 6 and 30 mm and is then rolled to form a hot strip with a degree of deformation of at least 50%. The hot strip can then be cold-rolled to a thickness of down to 0.150 mm.

The known alloys for a non-grain-oriented electrical steel have the disadvantage that the magnetic properties, in particular the hysteresis losses, depend greatly upon the frequency and amplitude of the magnetizing current. In particular, at high frequencies and higher amplitudes the hysteresis losses increase considerably, which has an adverse effect specifically in fast-running motors.

Therefore, there is a requirement for a steel strip consisting of a non-grain-oriented material having an alloy concept which minimizes the losses and keeps them constantly low even at high frequencies.

The object of the invention is to provide a steel strip for producing a non-grain-oriented electrical steel which, in comparison with known electrical steels, has considerably improved, frequency-independent, magnetic properties, in particular considerably reduced hysteresis losses. A further object is to provide a production method for such a steel strip.

SUMMARY OF THE INVENTION

The steel strip in accordance with the invention for producing a non-grain-oriented electrical steel has the following alloy composition in wt. %:

C: <0.03
Al: 1 to 12
Si: 0.3 to 3.5
Mn: >0.25 to 10
Cu: >0.05 to 3.0
Ni: >0.01 to 5.0,
the total of N, S and P: at most 0.07,
with the remainder being iron and melting-induced impurities, with the optional addition of one or more elements from Cr, Mo, Zn and Sn,
wherein the steel strip has an insulation layer substantially consisting of $Al_2O_3$ and/or $SiO_2$ having a thickness in the range of 10 μm to 100 μm.

In conjunction with the composition of the insulation layer, this means essentially that at least 50% of the insulation layer consists of $Al_2O_3$ or $SiO_2$ or the total of the two aforementioned constituents.

Preferably, the thickness of the insulation layer is in the range of 20 μm to 100 μm and particularly preferably in the range of 20 μm to 50 μm.

The steel strip comprising the alloy composition in accordance with the invention is characterized by considerably reduced hysteresis losses and by extensive independence of the magnetic properties from the frequency of the magnetizing current. As a result, the scope of application of this material in terms of energy and from an economic point of view can be considerably increased, in particular for fast-running electric motors and at high frequencies of the magnetizing current.

In particular, the maximum of 12% Al content produces a considerable increase in the electrical resistance and a corresponding reduction in the magnetic losses.

Moreover, through the addition of up to 12 wt. % aluminium the specific density of the steel is also reduced, which has a positive effect upon the weight of rotating motor parts and the resulting centrifugal forces specifically at high rotational frequencies.

Moreover, the strength is considerably increased by Al-containing precipitations in the steel. In order to achieve corresponding effects, the minimum content of aluminium is fixed to 1 wt. %. However, Al contents higher than 12 wt. % can result in difficulties during cold-rolling by reason of the formation of ordered phases. Therefore, it is advantageous to adhere to Al contents of up to 10 wt. %.

Although the hot strip according to claim 16 is hot-rolled at temperatures above 1000° C. or higher, very high scaling protection is provided. By reason of the extraordinarily high contents of Al of up to 12 wt. % or Si of up to 3.5 wt. %, a dense, intrinsically formed insulation layer is formed on the surface of the heated sheet and consists substantially of $Al_2O_3$ and/or $SiO_2$ which effectively reduces or even completely inhibits scaling of the iron in the steel. Moreover, the thickness of the layer can be influenced advantageously by the temperature and the duration of the annealing, in particular the final annealing of the steel strip, which generally is to be understood to be a cold strip. The thickness of the layer increases as the temperature and duration of the annealing increase. In an advantageous manner, a layer thickness of at least 10 μm, preferably of at least 20 μm, is achieved. However, this scale layer should not exceed a thickness of 100 μm, preferably 50 μm, so that, owing to the brittleness which likewise increases as the thickness increases, the layer does not negatively influence rollability by reason of spalling scale.

By virtue of the fact that this layer is retained in the further processing of the strip and functions in an electrically insulating manner, it is possible optionally to save on or considerably reduce an additional insulation layer between the sheet disks of the disk set. As a result, it is possible to save on otherwise necessary insulation material, thus reducing costs and component weight.

An addition of Si effects an increase in the electrical resistance. In accordance with the invention, in order to achieve an effect, a minimum content of 0.3 wt. % is required. For contents of more than 3.5 wt. % Si, the cold-rollability is reduced because the material becomes increasingly more brittle and edge cracks become increasingly visible on the steel strip. Therefore, contents of 1.0 to 3.0 wt. % and preferably of 1.5 to 2.5 wt. % are advantageously set. The addition of Si and Al in the selected alloy element contents represents an optimum combination of an increase in electrical resistance and a decrease in magnetic saturation polarization.

The content of carbon should be kept as low as possible in order to prevent, in the finished steel strip, magnetic ageing which is caused by carbide precipitations. Low carbon contents result in an improvement in the magnetic properties because fewer flaws caused e.g. by the carbon atoms and carbides occur in the material. Maximum carbon contents of 0.03 wt. % have been shown to be favorable.

The steels in accordance with the invention contain manganese in an amount of more than 0.25 to 10 wt. %. Manganese increases the specific volume resistance. In order to produce a corresponding effect, the steel should contain more than 0.25 wt. % manganese. In order to ensure problem-free further processing by hot-rolling and cold-rolling, the manganese content should not be above 10 wt. % owing to the formation of brittle phases. A negative effect of Mn for rollability depends in a complex manner upon the total of the elements Al, Si and Mn. In an advantageous manner, a total content of Mn+Al+Si of less than or equal to 20 wt. % should be maintained as an upper limit for rollability.

An addition of copper likewise increases the specific volume resistance. In order to achieve a corresponding effect, the Cu content should be more than 0.05 wt. %. Not more than 3 wt. % Cu should be alloyed to the steel because, otherwise, as a result of precipitations forming at the grain boundaries, rollability deteriorates and possibly solder cracking can occur during hot-rolling.

The addition of nickel has a positive effect in terms of reducing the magnetic losses. In order to achieve a corresponding effect, the minimum content should be above 0.01 wt. % but because nickel is a very expensive element, a maximum value 5.0 wt. % should not be exceeded for financial reasons. Preferably, the content of nickel is between 0.01 and 3.0 wt. %.

Furthermore, with the optional additions of chromium and molybdenum in contents of 0.01 to 0.5 wt. % in total or additions of zinc and tin of 0.01 to 0.05 wt. % in total, the specific volume resistance of the material can be influenced in an advantageous manner.

Taking into consideration good hot-rollability and cold-rollability, the following alloy variants have proven to be particularly favorable (wt. %):

Al: 1 to 6
Si: 0.5 to 1
Mn: >1.0 to 7
Cu: >0.1 to 2.0
Ni: >0.1 to 3.0.
or
Al: >6 to 10
Si: 0.5 to 0.8
Mn: >0.5 to 3
Cu: >0.1 to 2.5
Ni: >0.1 to 2.5.
or
Al: >6 to 10
Si: 0.3 to 0.5
Mn: >0.5 to 2
Cu: >0.1 to 0.5
Ni: >0.1 to 2.5.

In accordance with the invention, these alloy compositions can be used for producing steel strips having similar electromagnetic properties with a specific density of 6.40 to 7.30 g/cm$^3$ in order to meet the requirements of the lowest possible specific weight of the steel strip.

In accordance with the invention, the mechanical properties can likewise be varied within a broad spectrum by virtue of the different alloy concepts. Steel strips in accordance with the invention have a strength Rm of 450 to 690 MPa, a yield strength Rp0.2 of 310 to 550 MPa and an elongation A80 of 5 to 30%.

A method in accordance with the invention for producing a steel strip in accordance with the invention comprises the steps of:

melting a steel melt having a previously described alloy composition in accordance with the invention, casting the steel melt to form a pre-strip by means of a horizontal or vertical strip casting process approximating the final dimensions or casting the steel melt to form a slab or thin slab by means of a horizontal or vertical slab or thin slab casting process, re-heating the slab or thin slab to 1050° C. to 1250° C. and then hot-rolling the slab or thin slab to form a hot strip, or re-heating the pre-strip, produced to approximately the final dimensions, to 1000° C. to 1100° C. and then hot-rolling the pre-strip to form a hot strip, or hot-rolling the pre-strip without re-heating from the casting heat to form a hot strip with optional intermediate heating between the individual rolling passes of the hot-rolling, reeling the hot strip at a reeling temperature between 850° C. and room temperature, optionally annealing the hot strip with the following parameters:

annealing temperature: 550 to 800° C., annealing duration: 20 to 80 min., subsequent cooling in air, single or multi-stage finish-rolling of the hot strip or the pre-strip, produced to approximately the final dimensions, having a thickness of less than 3 mm to form steel strip having a minimum final thickness of 0.10 mm.

subsequently annealing the steel strip with the following parameters:

annealing temperature: 900 to 1080° C., annealing duration: 10 to 60 seconds with subsequent cooling in air to adjust an insulation layer substantially consisting of $Al_2O_3$ and/or $SiO_2$ on the steel strip having a thickness in the range of 10 μm to 100 μm, preferably in the range of 20 μm to 100 μm, particularly preferably in the range of 20 μm to 50 μm.

Even though, in principle, all conventional steel production methods (e.g. continuous casting, thin slab casting or thin strip casting) are suitable for producing the steel strip consisting of the alloy composition in accordance with the invention, the production of a steel strip in a horizontal strip casting installation has proven to be successful in steel production involving alloy variants which are difficult to produce, in particular with increased contents of manganese, aluminium and silicon, wherein the melt is cast in a flow-calmed manner and without bending to form a pre-strip in the range between 6 and 30 mm thickness and subsequently is rolled to form a hot strip with a degree of deformation of at least 50% in thicknesses of about 0.9 to 6.0 mm.

For the minimum thickness reduction degree, which is to be maintained, during hot-rolling, it has been demonstrated that this should likewise be increased as the Al content increases. Hence, in dependence upon the final strip thickness to be achieved and upon the Al content, reduction degrees of more than 50, 70 or even more than 90% are to be maintained in order to achieve a mixed structure of ordered and unordered phases. The high reduction degree is also necessary in order to destroy the microstructure in particular in the case of high Al alloys and thus to reduce the size of the grains (grain refinement). Higher Al contents thus require correspondingly higher reduction degrees.

The advantage of the proposed method can likewise be seen in the fact that when a horizontal strip casting installation is used, macro-segregations and cavities can be substantially avoided in the horizontal strip casting installation by reason of very homogeneous cooling conditions.

In terms of process technology, it is proposed for the strip casting process to achieve the flow-calming by virtue of the fact that a co-running electromagnetic brake which generates a field co-running synchronously or at optimum relative speed with respect to the strip is used and ensures that in the ideal case the speed of the melt feed is the same as the speed of the circulating conveyor belt. The bending which is considered to be disadvantageous during solidification is avoided by the fact that the underside of the casting belt receiving the melt is supported on a multiplicity of rollers lying next to one another. The support is enhanced such that a negative pressure is generated in the region of the casting belt so that the casting belt is pressed firmly onto the rollers. In addition, the Al-rich or Si-rich melt solidifies in an almost oxygen-free casting atmosphere.

In order to maintain these conditions during the critical phase of solidification, the length of the conveyor belt is selected such that at the end of the conveyor belt prior to its deflection the pre-strip is thoroughly solidified to the greatest possible extent.

The end of the conveyor belt is adjoined by a homogenization zone which is used for temperature equalization and possible stress reduction.

The pre-strip can be rolled to form hot strip either in-line or separately off-line. Prior to the off-line rolling, the pre-strip can either be directly hot-reeled or cut into panels after production and prior to cooling. The strip or panel material is then reheated after possible cooling and is unwound for off-line rolling or is reheated and rolled as a panel.

The rolling of the hot strip to final thickness can be performed by means of classic cold-rolling at room temperature or can be performed in accordance with the invention in a particularly advantageous manner at elevated temperature considerably above room temperature.

Since this rolling method does not correspond to classic cold-rolling at room temperature, the term "finish-rolling" is used hereinafter when a hot strip is finish-rolled to the required final thickness at elevated temperature.

An advantage of finish-rolling at elevated temperature resides in the fact that a possible tendency for edge cracks to be produced during rolling can thus be considerably reduced. Furthermore, it is thereby possible to influence the electromagnetic properties in a wide field, e.g. in respect of grain size, domain size distribution and Bloch wall stabilization.

It has proven to be favorable if the hot strip is heated to a temperature range of 350 to 570° C., preferably 350 to 520° C. and is finish-rolled to the designated final thickness at this temperature.

During multi-stage finish-rolling, it has proven to be successful, between the rolling steps, to perform reheating to a temperature of 600 to 800° C. with a dwell time of 20 min. to 80 min., wherein subsequently cooling to finish-rolling temperature is performed.

BRIEF DESCRIPTION OF THE DRAWING

The present invention will be more readily apparent upon reading the following description of currently preferred exemplified embodiments of the invention with reference to the accompanying drawing, in which the sole FIG. 1 shows various production routes for producing a steel strip in accordance with the invention.

DETAILED DESCRIPTION OF PREFERRED EMBODIMENTS

In dependence upon the specific alloy composition, a plurality of advantageous production routes have emerged for producing a steel strip in accordance with the invention, see FIG. 1. FIG. 1 illustrates three advantageous production routes.

The abbreviations below denote the following:

$T_{HR}$: hot-rolling at temperatures between 1000 to 1150° C.,

CR: cold-rolling, $T_1$, $T_{2C}$, $T_{3C}$: final annealing for all routes (900 to 1080° C., 10-60 s, air cooling), $T_{2A}$, $T_{2B}$, $T_{3A}$, $T_{3B}$: intermediate annealing for routes 2 and 3 (550 to 800° C., 20 to 80 min.), $T_R$: finish-rolling for route 3 at elevated temperatures of 350 to 570° C.

According to route 1, the hot strip is finish-rolled to the required final thickness at room temperature.

Should the alloy be too solid for classic cold-rolling at room temperature, a two-stage cold-rolling procedure according to route 2 can be used, in that rolling is performed initially at a thickness reduction degree of up to 60% to the desired final thickness at room temperature, then said alloy is rolled out at a temperature range of 550 to 650° C. for 40 to 60 min. and then the remaining 40% of the desired final thickness is achieved, in turn, by cold-rolling.

A material in particular comprising an increased Al content greater than 6 wt. % or Al+Si in total greater than 6 wt. % which has edge cracks after the first cold-rolling procedure can be produced according to route 3 by finish-rolling at elevated temperature. After heating in a temperature range of 350 to 600° C., preferably 350 to 520° C., rolling is performed and then reheating is performed iteratively in the aforementioned temperature range for 2-5 min. in each case between the rolling steps and finish-rolling is performed until the desired final thickness is achieved.

Some results relating to alloys in accordance with the invention are described hereinafter.

Alloys were tested as per table 1, wherein only the essential elements were determined. The alloys 13, 17 and 22 are in accordance with the invention and were tested in comparison with the reference material Ref1 not in accordance with the invention.

TABLE 1

| Alloy | Al | Si | Mn | Cu | Ni | P | S | C |
|---|---|---|---|---|---|---|---|---|
| | wt. % | | | | | | | |
| 13 | 9.90 | 0.45 | 0.97 | 0.98 | 0.02 | 0.003 | 0.003 | 0.012 |
| 17 | 7.90 | 0.53 | 1.91 | 0.20 | 0.02 | 0.003 | 0.003 | 0.024 |
| 22 | 6.10 | 0.49 | 2.04 | 2.10 | 0.02 | 0.055 | 0.003 | 0.005 |
| Ref1 | 1.90 | 1.93 | — | — | — | 0.004 | 0.003 | 0.001 |

Table 2 shows the mechanical properties of the alloys and the ascertained specific density of the materials. In addition to different mechanical properties, materials having different specific densities can also be produced, so that various requirements of the materials in accordance with the invention can be met.

TABLE 2

Mechanical properties; 0.7 mm thick

| Alloy | Rp0.2 [N/mm$^2$] | Rm | A80 [%] | Density [kg/dm$^3$] |
|---|---|---|---|---|
| 13 | 679 | 688 | 2 | 6.8 |
| 17 | 570 | 635 | 6 | 6.9 |
| 22 | 560 | 600 | 1.6 | 7.1 |
| Ref1 | 500 | 600 | 15.0 | 7.6 |

Table 3 shows the results of the measurement of the frequency dependence of the magnetic flux density $B_{max}$ of steel sheets having a thickness of 0.7 mm of the tested alloys. The measurements were performed at frequencies f of 50, 200, 400, 750 and 1000 Hz. The results tellingly prove the extensive frequency independence of the magnetic flux density and thus the hysteresis losses in a periodic alternating field.

TABLE 3

Frequency dependence (f = 50-1000 Hz); 0.7 mm thickness

| f [Hz] Alloy | 50 | 200 | 400 | 750 | 1000 |
|---|---|---|---|---|---|
| | Bmax [T] | | | | |
| 13 | 1.38 | 1.39 | 1.39 | 1.39 | 1.39 |
| 17 | 1.44 | 1.44 | 1.44 | 1.44 | 1.44 |
| 22 | 1.44 | 1.44 | 1.45 | 1.45 | 1.45 |

What is claimed is:

1. A steel strip for producing a non-grain-oriented electrical steel sheet comprising a following alloy composition in wt. %:

C: ≤0.03

Al: 1 to 12

Si: 0.3 to 3.5

Mn: >0.25 to 10

Cu: >0.05 to 3.0

Ni: >0.01 to 5.0, a total of N, S and P: at most 0.07, with the remainder being iron and melting-induced impurities, said steel strip comprising an insulation layer substantially including $Al_2O_3$ and/or $SiO_2$ having a thickness in a range of 20 μm to 100 μm, wherein the alloy composition includes at least one element selected from the group consisting of Cr, Mo, Zn and Sn, wherein a total content of Cr and Mo is 0.01 to 0.5 wt. %.

2. The steel strip of claim 1, wherein the thickness of the insulation layer is in a range of 20 μm to 50 μm.

3. The steel strip of claim 1, wherein a total content of Zn and Sn is 0.01 to 0.05 wt. %.

4. The steel strip of claim 1, wherein a maximum Al content is 10 wt. %.

5. The steel strip of claim 1, wherein a maximum total content of Mn and Al is 20 wt. %.

6. The steel strip of claim 1, wherein an Si content is 1.0 to 3.0 wt %.

7. The steel strip of claim 1, wherein an Si content is 1.5 to 2.5 wt. %.

8. The steel strip of claim 1, wherein a maximum Ni content is 3 wt. %.

9. The steel strip of claim 1, wherein the alloy composition includes in wt. %:

Al: 1 to 6

Si: 0.5 to 1
Mn: >1.0 to 7
Cu: >0.1 to 2.0
Ni: >0.1 to 3.0.

10. The steel strip of claim 1, wherein the alloy composition includes in wt. %:
Al: >6 to 10
Si: 0.5 to 0.8
Mn: >0.5 to 3
Cu: >0.1 to 2.5
Ni: >0.1 to 2.5.

11. The steel strip of claim 10, wherein the alloy composition includes in wt. %:
Si: 0.3 to 0.5
Mn: >0.5 to 2
Cu: >0.1 to 0.5.

12. The steel strip of claim 1, wherein the steel strip has a specific density of 6.40 to 7.3 g/cm$^3$.

13. The steel strip of claim 1, wherein the steel strip has a strength Rm of 450 to 690 MPa, a yield strength Rp0.2 of 310 to 550 MPa and an elongation A80 of 5 to 30%.

14. A method for producing a steel strip for producing a non-grain-oriented electrical steel sheet, said method comprising:
melting a steel melt made from a steel comprising a following ahoy composition in wt. %:
C: ≤0.03
Al: 1 to 12
Si: 0.3 to 3.5
Mn: >0.25 to 10
Cu: >0.05 to 3.0
Ni: >0.01 to 5.0,
a total of N, S and P: at most 0.07, with the remainder being iron and melting-induced impurities;
casting the steel melt to form a pre-strip by means of a horizontal or vertical strip casting process approximating a final dimension or casting the steel melt to form a slab or thin slab by means of a horizontal or vertical slab or thin slab casting process;
re-heating the slab or thin slab to 1050° C. to 1250° C. and then hot-rolling the slab or thin slab to form a hot strip, or re-heating the pre-strip, produced to approximately final dimension, to 1000° C. to 1100° C. and then hot-rolling the pre-strip to form a hot strip, or hot-rolling the pre-strip without re-heating from the casting heat to form a hot strip with optional intermediate heating between individual rolling passes of the hot-rolling;
reeling the hot strip at a reeling temperature between 850° C. and room temperature,
single or multi-stage finish-rolling of the hot strip or the pre-strip, produced to approximately final dimension, having a thickness of less than 3 mm to form a steel strip having a minimum final thickness of 0.10 mm; and
subsequently annealing the steel strip with the following parameters: annealing temperature: 900 to 1080° C., annealing duration: 10 to 60 seconds with subsequent cooling in air to adjust an insulation layer substantially including $Al_2O_3$ and/or $SiO_2$ on the steel strip having a thickness in a range of 20 μm to 100 μm,
wherein the alloy composition includes at least one element selected from the group consisting of Cr, Mo, Zn and Sn,
wherein a total content of Cr and Mo is 0.01 to 0.5 wt. %.

15. The method of claim 14, wherein the hot strip is annealed with the following parameters: annealing temperature: 550 to 800° C., annealing duration:
20 to 80 min, and subsequently cooled in air.

16. The method of claim 14, further comprising, prior to the finish-rolling, heating the hot strip to a temperature above room temperature, wherein the finish-rolling is executed at said temperature to the final thickness.

17. The method of claim 14, further comprising, prior to the finish-rolling, heating the hot strip to a temperature of 350 to 570° C., wherein the finish-rolling is executed at said temperature to the final thickness.

18. The method of claim 14, further comprising heating the hot strip, prior to the finish-rolling, to a temperature of 360 to 520° C., wherein the finish-rolling is executed at said temperature to the final thickness.

19. The method of claim 14, further comprising in a multi-stage finish-rolling procedure, between rolling steps, reheating to a temperature of 600 to 800° C. followed by cooling to rolling temperature.

20. A steel strip for producing a non-grain-oriented electrical steel sheet comprising a following alloy composition in wt. %:
C: ≤0.03
Al: >6 to 10
Si: 0.5 to 0.8
Mn: >0.5 to 3
Cu: >0.1 to 2.5
Ni: >0.1 to 2.5,
a total of N, S and P: at most 0.07,
with the remainder being iron and melting-induced impurities,
said steel strip comprising an insulation layer substantially including $Al_2O_3$ and/or $SiO_2$ having a thickness in a range of 20 μm to 100 μm.

* * * * *